US006334457B1

(12) United States Patent
Baker, IV

(10) Patent No.: US 6,334,457 B1
(45) Date of Patent: Jan. 1, 2002

(54) COLLAPSING HOSE MANAGEMENT SYSTEM AND METHOD FOR GASOLINE DISPENSING UNIT

(75) Inventor: Frank A. Baker, IV, Salisbury, MD (US)

(73) Assignee: Dresser, Inc., Addison, TX (US)

( * ) Notice: Subject to any disclaimer, the term of this patent is extended or adjusted under 35 U.S.C. 154(b) by 0 days.

(21) Appl. No.: 09/516,068

(22) Filed: Mar. 1, 2000

Related U.S. Application Data

(60) Provisional application No. 60/122,356, filed on Mar. 2, 1999.

(51) Int. Cl.[7] ..... B65H 75/34

(52) U.S. Cl. ..... 137/1; 137/355.16; 137/355.2

(58) Field of Search ..... 137/355.19, 355.2, 137/355.26, 355.16, 1; 222/527, 530, 538

(56) References Cited

U.S. PATENT DOCUMENTS

| | | | | | |
|---|---|---|---|---|---|
| 745,633 | A | | 12/1903 | Lindsay et al. | |
| 955,342 | A | | 4/1910 | Maxwell | |
| 1,151,890 | A | * | 8/1915 | McConnell | 137/355.19 |
| 1,485,663 | A | | 3/1924 | Best | |
| 1,794,825 | A | | 3/1931 | Benedict | |
| 1,926,452 | A | | 9/1933 | Norling | 242/107 |
| 1,933,925 | A | | 11/1933 | Norling | 242/107 |
| 2,117,928 | A | | 5/1938 | Wardell | 267/73 |
| 2,545,063 | A | | 3/1951 | Wolfe | 222/74 |
| 2,564,623 | A | | 8/1951 | Harks | 299/77 |
| 2,694,601 | A | | 11/1954 | Higginbotham | 299/77 |
| 2,939,680 | A | | 6/1960 | Powell | 254/168 |
| 3,160,333 | A | | 12/1964 | Budrow | 222/530 |
| 3,612,094 | A | | 10/1971 | Hare | 137/355.2 |
| 3,661,170 | A | * | 5/1972 | Mitchell | 137/351 |
| 4,066,093 | A | * | 1/1978 | Egerstrom | 137/355.2 |
| 4,131,218 | A | | 12/1978 | Tatsuno | 222/527 |
| 4,380,244 | A | | 4/1983 | Caudill et al. | 137/355.16 |
| 4,877,366 | A | * | 10/1989 | Filippi | 414/517 |
| 5,018,549 | A | | 5/1991 | Lucas | 137/355.23 |
| 5,054,162 | A | | 10/1991 | Rogers | 16/198 |
| 5,074,483 | A | | 12/1991 | Wang | 242/107 |
| 5,139,751 | A | | 8/1992 | Mansfield et al. | 422/292 |
| 5,211,203 | A | * | 5/1993 | Vollweiler et al. | 137/355.17 |
| 5,450,874 | A | | 9/1995 | Hamula | 137/355.25 |
| 5,558,118 | A | * | 9/1996 | Mooring | 137/342 |
| 5,794,648 | A | | 8/1998 | Jentzsch et al. | 137/355.23 |
| 5,836,343 | A | * | 11/1998 | Jones | 137/355.26 |

FOREIGN PATENT DOCUMENTS

| | | | |
|---|---|---|---|
| EP | 0 150 686 | 8/1985 | B64F/1/28 |
| EP | 0 255 979 | 2/1988 | B67D/5/365 |
| EP | 0 291 876 | 11/1988 | B67D/5/01 |
| EP | 0 369 089 | 5/1990 | B67D/5/365 |
| EP | 0 379 742 | 8/1990 | B67D/5/365 |
| EP | 0 393 229 | 10/1990 | B67D/5/01 |
| EP | 0 404 170 | 12/1990 | E03F/1/00 |
| EP | 0 418 744 | 3/1991 | B60S/5/02 |
| EP | 0 590 241 | 4/1994 | B67D/5/365 |
| EP | 0 640 557 | 3/1995 | B67D/5/365 |
| EP | 0 647 587 | 4/1995 | B67D/5/365 |
| EP | 0 675 074 | 10/1995 | B67D/5/64 |
| EP | 0 694 499 | 1/1996 | B67D/5/365 |
| EP | 0 696 550 | 2/1996 | B67D/5/60 |
| EP | 0 846 651 | 6/1998 | B67D/5/37 |
| WO | PCT/WO 94/01327 | 1/1994 | B64F/1/28 |

* cited by examiner

*Primary Examiner*—George L. Walton
(74) *Attorney, Agent, or Firm*—Jenkens & Gilchrist, P.C.

(57) ABSTRACT

A hose management system according to which two pulleys are respectively mounted for rotation to at least one pair of telescoping members. A hose extends around the pulleys, so that movement of the hose causes the pulleys move relative to each other, and the telescoping member to extend and retract in response to the movement of the pulleys.

15 Claims, 4 Drawing Sheets

COLLAPSING HOSE MANAGEMENT SYSTEM AND METHOD FOR GASOLINE DISPENSING UNIT

CROSS-REFERENCE TO RELATED APPLICATION

This application is based on provisional application Ser. No. 60/122,356 filed on Mar. 2, 1999.

BACKGROUND

This invention relates to retail gasoline dispensing units and, more particularly, to such a unit including a hose management system to control and assist in the use of the fuel dispensing hose.

A gasoline dispensing unit includes at least one dispensing hose which is connected at one end to a conduit in the interior of the unit which conduit is connected to an underground storage tank for the gasoline. A portion of the hose extends out from the dispensing unit, and a nozzle is provided on the other end of the hose for dispensing the gasoline into vehicles. However, the hose often is difficult to maneuver and becomes tangled. This creates significant problems, especially in connection with self-service stations, and the like.

Therefore what is needed is a hose for a gasoline dispensing unit which is easy to manage and does not tangle.

SUMMARY

To this end, an embodiment of the present invention is directed to a hose management system according to which two pulleys are respectively mounted for rotation to at least one pair of telescoping members. A hose extends around the pulleys, so that movement of the hose causes the pulleys move relative to each other, and the telescoping member to extend and retract in response to the movement of the pulleys.

Since the hose does not become tangled and can be easily pulled from, and retracted into, the housing, it is easy to manage and is especially useful in self-service filling stations and the like.

DESCRIPTION OF A PREFERRED EMBODIMENT

Figure 1:
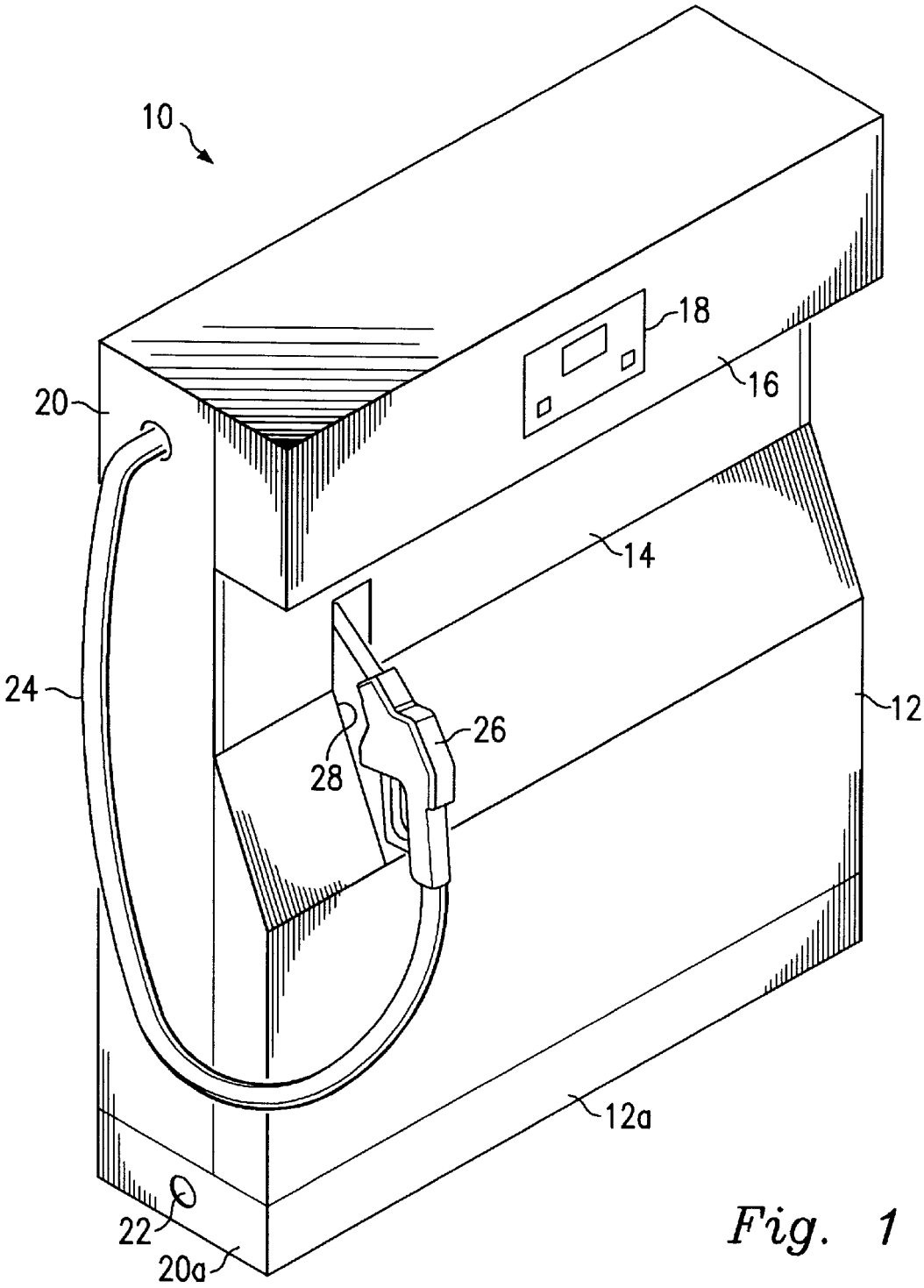
FIG. 1 is an isometric view of a fuel dispensing unit incorporating a hose management system according to an embodiment of the present invention.

In FIG. 1, the reference numeral 10 designates a fuel dispensing unit such as the type utilized in gasoline service stations, and the like. The unit 10 includes a hydraulics cabinet 12 having a base portion 12*a* adapted to rest on the ground and containing the various hydraulic connections required for the dispensing of fuel. An interface cabinet 14 extends between the main housing 12 and an electronics housing 16 for housing various electronic components and wiring. A sales display unit 18 is mounted on the front panel of electronics housing 16 and is adapted to display information regarding the customer transaction such as price, amount of fuel and cost per unit of fuel, or other customer-related messages. Since all of the above is conventional, it will not be described in any further detail.

An auxiliary housing 20 extends adjacent the cabinets 12 and 14 and rests on a base 20*a* which has an inlet 22 for receiving a source of pressurized air for reasons to be described. It is understood that the cabinets 12 and 14 and the housings 16 and 20 can be bolted together and the bases 12*a* and 20*a* secured to the ground in any known manner.

A portion of a hose 24 extends from the cabinet and is connected at one end to a nozzle 26 which is mounted in a boot 28 during non-use. The remaining portion of the hose 24 is supported in the cabinet 20 and can be pulled from the cabinet, in a manner to be described.

Figure 2:
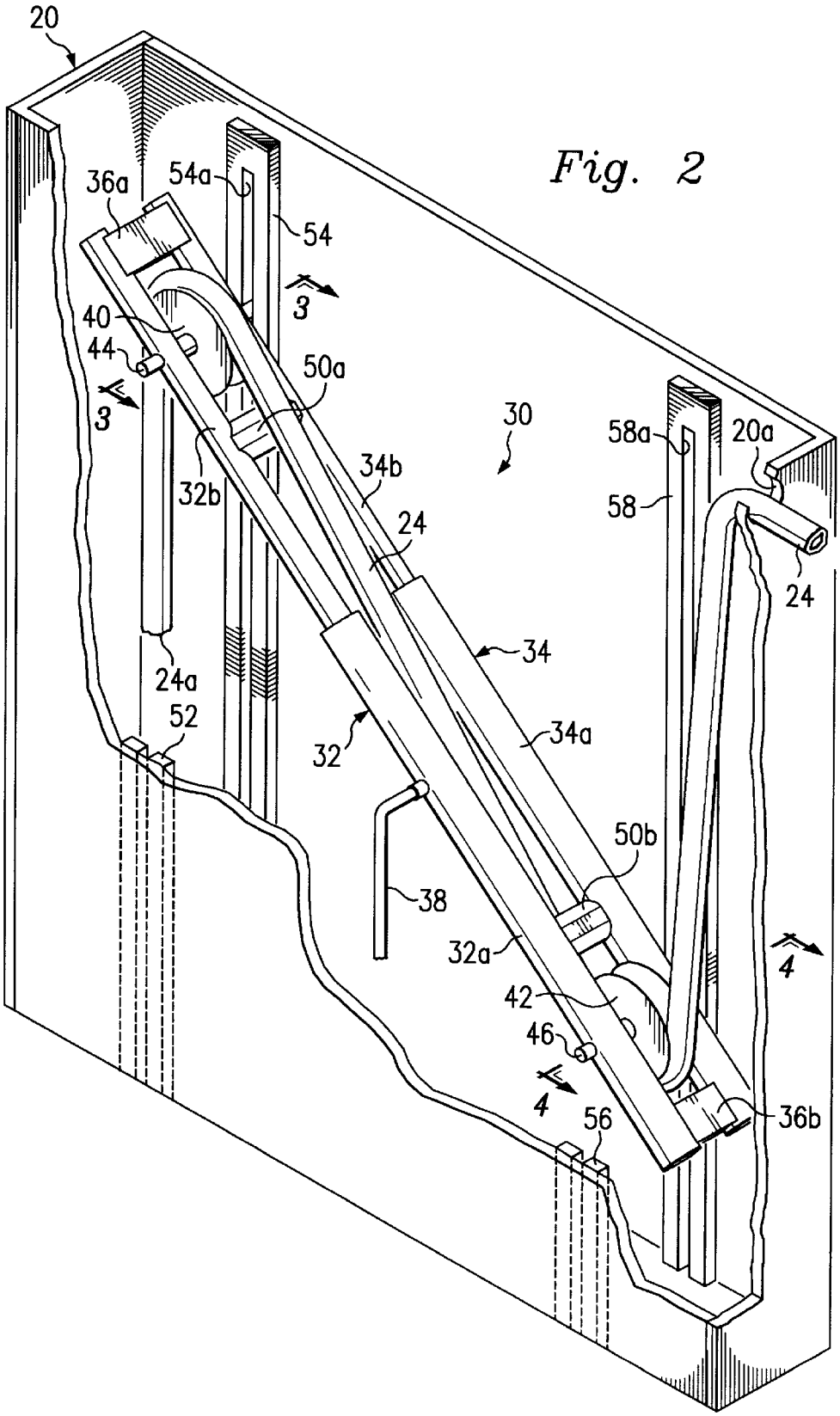
FIG. 2 is an isometric view of the hose management system according to an embodiment of the present invention.

A management system for the hose 24 is shown in general by the reference numeral 30 in FIG. 2 and is disposed in the interior of the housing 20. The system 30 includes a pair of telescoping guides 32 and 34 disposed in a spaced, parallel relation and connected, at their ends to end caps 36*a* and 36*b*, respectively. The guide 32 is formed by two telescoping members 32*a* and 32*b*, and the guide 34 is formed by two telescoping members 34*a* and 34*b*. The telescoping members 32*a*, 32*b* and 34*a*, 34*b* are in the form of pneumatic cylinder-piston devices with the members 32*a* and 34*a* serving as cylinders and the members 32*b* and 34*b* serving as pistons. An air hose 38 is provided that extends from the air inlet 22 (FIG. 1) for introducing air into the member 32*a* to provide energy to extend the member 32*b* in a conventional manner. Although not shown in the drawing an air hose similar to the air hose 38 also extends from the air inlet 22 for introducing air into the member 34*a* to extend the member 34*b*.

Two pulleys 40 and 42 are rotatably mounted about shafts 44 and 46 which extend through the respective end portions of the guides 32 and 34 and project from the guides a relative short distance for reasons to be described.

A pair of support spacers 50*a* and 50*b* extend between the guides 32 and 34 just inside the pulleys 40 and 42 respectively to support the guides in their spaced relationship and add rigidity to the frame formed by the guides and the end caps 36*a* and 36*b*.

Figure 3:
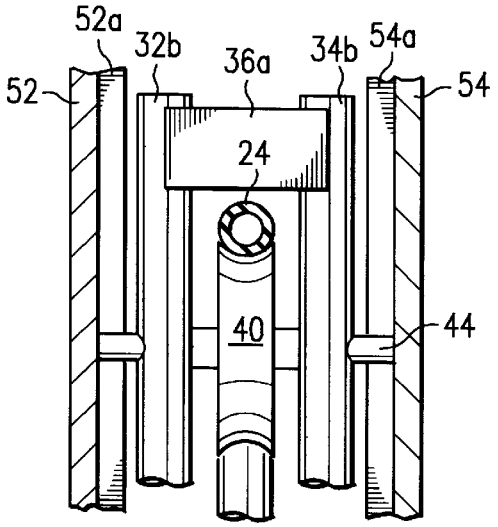
FIG. 3 is a cross-sectional view taken along the line 3—3 of FIG. 2.
Figure 4:
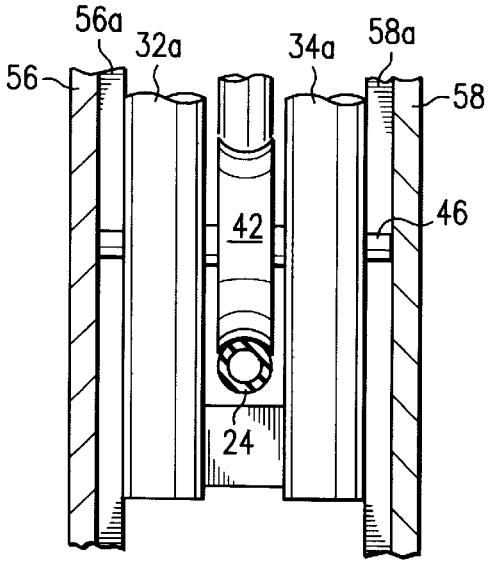
FIG. 4 is a cross-sectional view taken along the line 4—4 of FIG. 2.

The frame formed by the guides 32 and 34 and the end caps 36*a* and 36*b* moves in the cabinet 20 during operation. To this end, and with reference to FIG. 3, a pair of guide members 52 and 54 are provided to each side of the pulley 40 and have slots 52*a* and 54*a*, respectively, formed therein which receive the respective projecting end portions of the shaft 44. Thus, the guide members 52 and 54 permit movement of the pulley 40 in a vertical direction as shown in FIG. 2, and restrain movement in any other direction. Similarly, and as shown in FIG. 4, a pair of guide members 56 and 58 are provided to each side of the pulley 42 and have slots 56*a* and 58*a*, respectively formed therein which receive the respective projecting end portions of the shaft 46. Thus, the guide members 56 and 58 permit movement of the pulley 42 in a vertical direction as shown in FIG. 2, and restrain movement in any other direction. The telescoping members 32*a*, 32*b* and 34*a*, 34*b*, are adapted to extend and retract in response to the pulleys 40 and 42 moving away from, and towards, each other when the hose 14 is pulled from and inserted into, the housing 20, respectively under conditions to be described.

Referring again to FIG. 2, one end 24*a* of the hose 24 is adapted for connection to a conduit (not shown) that extends into the housing 20 which conduit, in turn, is connected to an underground storage tank for the fuel. The hose 24 extends from the latter conduit, around the pulley 40, between the guides 32 and 34 and around the pulley 42 before exiting the housing 20 through an opening 20*a* formed in a side wall of the housing. The other end of the hose 24 is connected to the nozzle 26 (FIG. 1) for dispensing fuel into the tanks of vehicles parked adjacent the dispenser unit 10.

Figure 5:
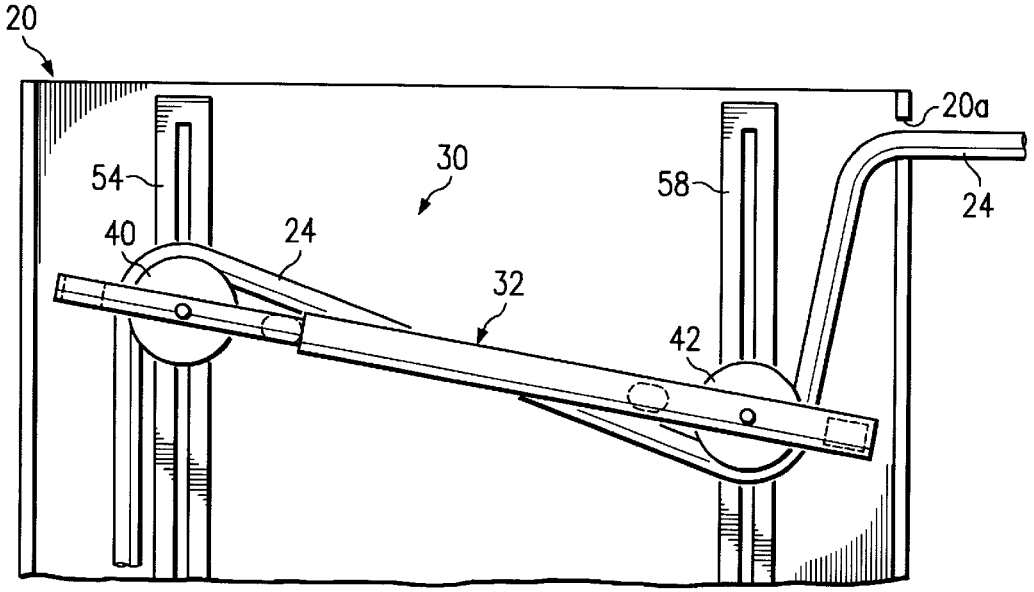
FIG. 5 is a view, similar to FIG. 2 but depicting the system of FIG. 1 in a different operational position.

Referring to FIG. 1, when the nozzle 26 is not in use it rests in the boot 28 and the system 30 is an a rest position as shown in FIG. 2. The operation of the system 30 is initiated when a customer or attendant grabs the nozzle 26 and pulls the hose 24 towards a vehicle parked adjacent the dispenser unit 10. This pulling causes the pulley 42 to move upwardly in a vertical direction in the housing 20 and the guides 32 and 34 to retract to reduce their respective lengths until the latter pulley reaches a position just below the opening 20*a* in the cabinet 20 as shown in FIG. 5. During this movement, a length of the hose 24 is pulled through the opening 20*a* to allow the nozzle to be moved to, or at least towards, the vehicle.

If an additional length of the hose 24 is needed by the customer or operator to reach the vehicle, the hose is pulled further which cause the guide members 32 and 34 to retract further and the pulley 40 to move downwardly until it reaches a position slightly above the position of the pulley 42 as shown in FIG. 5. During this latter movement, the pulley 42 establishes a fulcrum point and the guides 32 and 34 in effect, act as pivotal lever arms. This movement enables an additional length of the hose 24 to be pulled through the opening 20*a* to allow the nozzle 26 to be moved to the vehicle. In this position, the guide members are at their maximum contraction.

After refueling of the vehicle is complete and the customer relaxes the tension on the hose 24 prior to returning the nozzle 26 to the boot 28, the pulley 42 moves downwardly in a vertical direction, by gravity. When the nozzle 26 is then returned to the boot 28, a signal is sent to the above-mentioned air source, and air is introduced into the hose 38, and the hose associated with the guide 34 to extend the members 32*b* and 34*a* relative to the members 32*a* and 34*a*. This, in turn, causes expansion of the guides 32 and 34 forcing the pulley 40 upwardly, and the pulley 42 downwardly, in the cabinet 20 until they reach the rest position of FIG. 2 after which the introduction of air into the members 32*a* and 34*a* is terminated. This movement takes up the amount of hose 24 that was previously withdrawn from the cabinet 20, as described above Therefore, as a result of this movement of the system 30 in the cabinet 20 along with the telescoping movement of the guides 32 and 34, the hose 24 easy to manage and use and minimizes any tangling or jamming of the hose.

Figure 6:
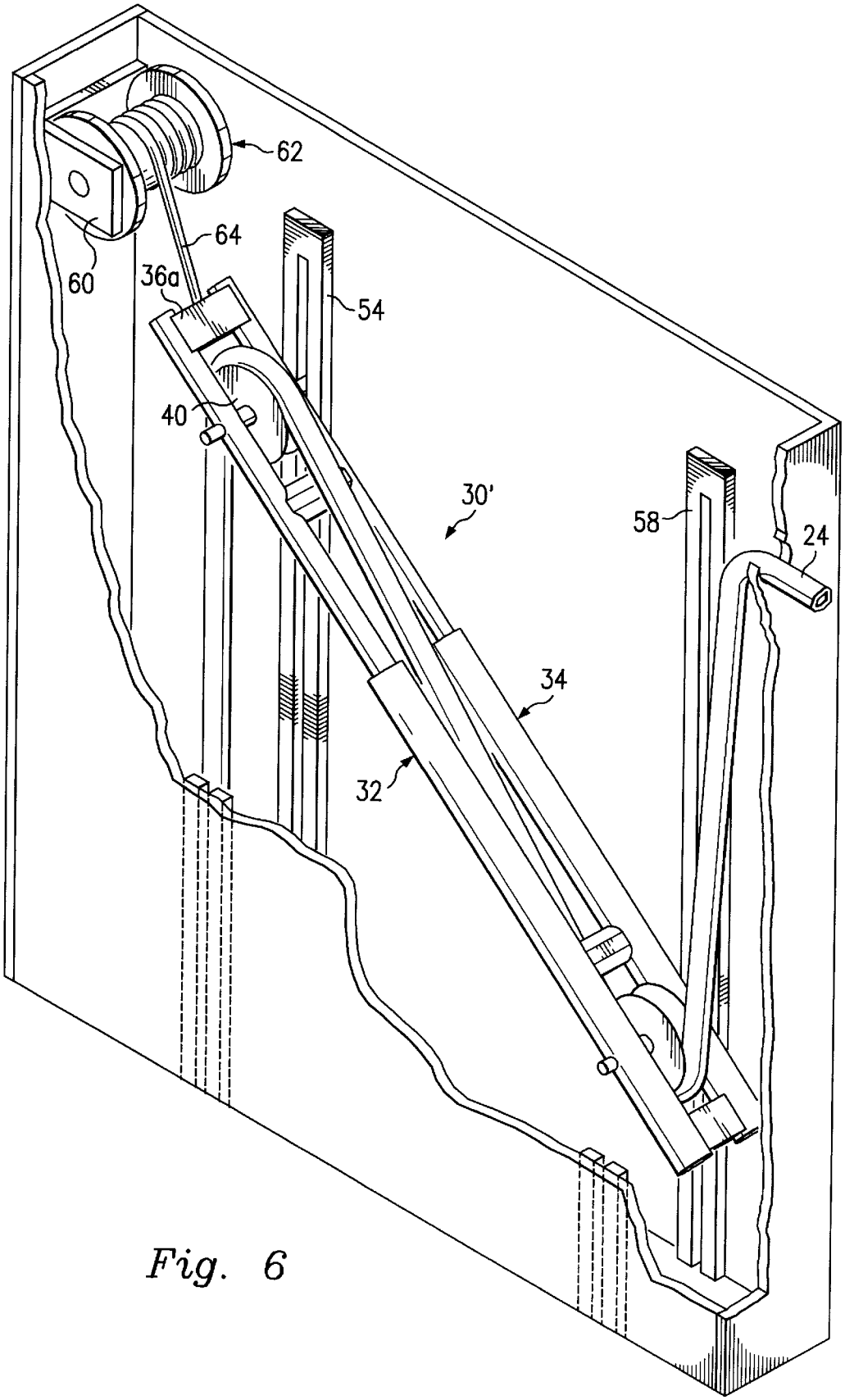
FIG. 6 is a view, similar to FIG. 2 but depicting an alternate embodiment of the system of the present invention.

According to the embodiment of FIG. 6 a system 30' is provided which, other than the exceptions noted below, has identical components which are given the same reference numerals. Although the system 30' includes two guide members 32 and 34 that are identical to the guide members of the present invention, there is no air hose 38 and no air is introduced into the members 32*a* and 34*a* to expand the members 32*b* and 34*b*, respectively.

Rather, a bracket 60 is mounted to a side wall of the cabinet 20 opposite the wall through which the opening extends, in any conventional manner, and a reel 62 is rotatably mounted to the bracket 60, also in any conventional manner. One end of a cord 64 is connected to the reel 62, some of the cord is wrapped around the reel 62, and other end of the cord is connected to the end cap 36*a*. The reel 62 is spring loaded and, as such, exerts an upwardly directed tension on the cord 64 which, in turn, exerts a upwardly-directed pulling force on the pulley 40. Since the reel 62 is conventional, it will not be described in any further detail.

As in the previous embodiment, when the nozzle 26 is not in use it rests in the boot 28 and the system 30' is an a rest position as shown in FIG. 2 with the reel 62 exerting an upwardly directed force on the pulley 40, via the cord 64. The operation of the system 30' is initiated when a customer or attendant grabs the nozzle 26 and pulls the hose 24 towards a vehicle parked adjacent the dispenser unit 10. This pulls the pulley 42 upwardly in a vertical direction in the housing 20 and causes the guides 32 and 34 to retract to reduce their respective lengths until the pulley 42 reaches a position just below the opening 20*a* in the cabinet 20 as in the previous embodiment. During this movement, a length of the hose 24 is pulled through the opening 20*a* to allow the nozzle to be moved to, or at least towards, the vehicle.

If an additional length of the hose 24 is needed by the customer or operator to reach the vehicle, the hose is pulled further which cause the guide members 32 and 34 to retract further and the pulley 40 to move downwardly against the force applied by the reel 62, until it reaches the same position as shown in FIG. 5 in connection with the previous embodiment. During this latter movement, the pulley 42 establishes a fulcrum point and the guides 32 and 34 in effect, act as pivotal lever arms. This movement enables an additional length of the hose 24 to be pulled through the opening 20*a* to allow the nozzle 26 to be moved to the vehicle.

After refueling of the vehicle is complete and the customer relaxes the tension on the hose 24 prior to returning the nozzle 26 to the boot 28, the pulley 42 moves downwardly in a vertical direction, by gravity and the spring tension provided by the reel 62 forces the pulley 40 upwardly to extend the members 32b and 34a relative to the members 32*a* and 34*a*. This, in turn, forces the pulley 42 downwardly and the spring tension on the reel 62 is calibrated so that the pulleys 40 and 42 come to the rest position of FIG. 2. This movement takes up the amount of hose 24 that was previously withdrawn from the cabinet 20, as described above2. A Therefore, the embodiment of FIG. 6 enjoys the same advantages as the embodiment of FIGS. 1–5.

It is understood that variations may be made in the foregoing without departing from the scope of the invention. For example, only one set of telescoping members can be provided rather than the two sets described in the example above. Also, spatial references, such as "upper", "lower", "side", "vertical", "upward", "downward", etc. are for the purpose of illustration only and do not limit the specific orientation or location of the structure described above.

Since other modifications, changes, and substitutions are intended in the foregoing disclosure, it is appropriate that the appended claims be construed broadly and in a manner consistent with the scope of the invention.

What is claimed is:

1. A hose management system comprising a housing having an opening; a telescoping frame disposed in the housing; at least two guides fixed in the housing and engaged by the frame for guiding the frame for translational movement in the housing; two rotatable pulleys respectively mounted to the frame in a spaced relation; and a hose extending around the pulleys and through the opening in the housing, so that pulling of the hose from the opening causes the translational movement of the frame, the translational movement of the frame relative to the guides causing corresponding telescoping movement of the frame and movement of the pulleys to control the amount of hose pulled from the opening and to prevent tangling of the hose.

2. The system of claim 1 wherein there are two guides disposed in a spaced relation in the housing, and wherein the frame comprises at pair of telescoping members, one telescoping member engaging one of the guides and the other telescoping member engaging the other guide, so that transnational movement of one telescoping member relative to the other telescoping member causes telescoping movement between the telescoping members between a retracted position and an extended position, and between the extended position and the retracted position.

3. The system of claim 2 wherein the two pulleys are mounted to the two telescoping members, respectively, and wherein, in the fully extended position of the telescoping members, one of the pulleys extends below the other pulley, and in the fully retracted position, the pulleys extend at approximately the same height.

4. The system of claim 1 wherein during movement of the telescoping members from their retracted position to their extended position, the distance between the pulleys, and the amount of the hose extending between the pulleys increases, and during movement of the telescoping members from their extended position to their retracted position, the amount of the hose extending between the pulleys decreases.

5. The system of claim 1 wherein, in a rest position of the system, the telescoping members are in their extended position with one of the pulleys extending below the other pulley and below the opening in the housing.

6. The system of claim 5 wherein the one pulley moves from the rest position upwardly in the housing towards the opening in response to the pulling of the hose through the opening to cause telescoping movement of the telescoping members towards their retracted position.

7. The system of claim 6 wherein, when the one pulley reaches a position near the opening, the other pulley moves downwardly in the housing to cause telescoping movement of the telescoping member towards their extended position.

8. The system of claim 6 further comprising means responsive to termination of the pulling of the hose for causing telescoping movement of the telescoping members to their extended position.

9. The system of claim 8 wherein the means comprises a source of air, and means for introducing air from the source into one of the telescoping members for extending the telescoping members.

10. The system of claim 8 wherein the means comprises a spring-loaded reel, and a cord wound about the reel and connected to one end of one of the telescoping members for urging the one end to in a direction that extends the length of the frame.

11. The system of claim 2 wherein each of the guides has a slot formed therein and wherein each telescoping member has a element that moves in its corresponding slot in response to cause the telescoping movement of the telescoping members.

12. The system of claim 11 wherein the slots extend vertically and wherein the elements extend from the respective end portions of the frame and into their respective slots so that movement of the elements in the slots causes substantially vertical movement of the end portions.

13. The system of claim 2 wherein the frame comprises an additional pair of telescoping members disposed in a spaced relation to the first mentioned pair of telescoping members; and wherein the rollers are mounted between the spaced pairs of telescoping members.

14. A method of managing a hose, the method comprising mounting a telescoping frame in at least two guides in a housing so that transnational movement of the frame relative to the guides causes telescoping movement of the frame from an extended position to a retracted position, attaching two rotatable pulleys to the frame in a spaced relation; and extending a hose around the pulleys and through an opening in the housing, so that pulling of the hose from the opening causes corresponding movement of the frame relative to the guides and corresponding telescoping movement of the frame from the extended position to the retracted position, to control the amount of hose pulled through the opening and to prevent tangling of the hose.

15. The method of claim 14 further comprising the moving the frame from the retracted position to the extending position.

* * * * *

UNITED STATES PATENT AND TRADEMARK OFFICE

CERTIFICATE OF CORRECTION

PATENT NO. : 6,334,457
DATED : January 1, 2002
INVENTOR(S) : Baker, IV

It is certified that error appears in the above-identified patent and that said Letters Patent is hereby corrected as shown below:

Column 5,
Line 28, replace "Claim 1" with -- Claim 3 --.
Line 35, replace "Claim 1" with -- Claim 3 --.

Signed and Sealed this

Fourteenth Day of May, 2002

*Attest:*

*Attesting Officer*

JAMES E. ROGAN
*Director of the United States Patent and Trademark Office*